United States Patent [19]

Pardini

[11] Patent Number: 4,733,032

[45] Date of Patent: Mar. 22, 1988

[54] ELECTRIC CIRCUIT BREAKER ARC CHUTE COMPOSITION

[75] Inventor: Franco P. Pardini, Milan, Italy

[73] Assignee: General Electric Company, New York, N.Y.

[21] Appl. No.: 55,967

[22] Filed: Jun. 1, 1987

[51] Int. Cl.[4] ..... H01H 33/02

[52] U.S. Cl. ..... 200/144 C; 200/149 A

[58] Field of Search ..... 200/144 C, 149 A, 149 R

[56] References Cited

U.S. PATENT DOCUMENTS

| | | | |
|---|---|---|---|
| 2,005,684 | 6/1935 | Sachs | 200/144 R |
| 2,439,929 | 4/1948 | Hill et al. | 200/148 C |
| 2,551,822 | 5/1951 | Bingenheimer et al. | 200/144 R |
| 3,761,660 | 9/1973 | Jones | 200/144 C |
| 3,986,213 | 1/1974 | Holmstrom | 200/149 A |
| 4,278,859 | 7/1981 | Borona | 200/144 C |
| 4,375,021 | 2/1983 | Pardini et al. | 200/147 R |

*Primary Examiner*—Robert S. Macon

*Attorney, Agent, or Firm*—Richard A. Menelly; Walter C. Bernkopf; Fred Jacob

[57] ABSTRACT

A current limiting circuit breaker having a pair of separable contacts closely spaced for electrodynamic repulsion upon the occurrence of a short circuit overload condition utilizes an arc chute to cool and extinguish the arc that occurs when the contacts become separated. The arc chute contains a plurality of metal arc plates supported by side plates which also assist in cooling and extinguishing the arc. The side plates are formed from a two-layer configuration wherein the first layer has excellent arc extinguishing properties while the second layer has good mechanical support strength. The side plates are oriented such that the first layers face the contacts.

16 Claims, 5 Drawing Figures

ELECTRIC CIRCUIT BREAKER ARC CHUTE COMPOSITION

BACKGROUND OF THE INVENTION

U.S. Pat. No. 4,375,021, in the name of Franco T. Pardini and Francesco DeVizzi, describes the use of a magnetic assembly arranged about the circuit breaker contacts for electrodynamically repulsing the contacts and for electrodynamic motivation of the arcs that occur when the contacts become separated. The arc chute used within the breaker for cooling and extinguishing the arc is formed by enfolding a metal strip partially around an insulating support substrate.

U.S. Pat. Nos. 2,005,684 and 2,551,822 both teach arc chute assemblies that contain a composite structure of one material having good arc resistant properties such as asbestos alongside another material having good physical support properties. Asbestos materials, having excellent high temperature and electrical resistance properties, however, are no longer available to the electrical industry by legislative mandate.

When the Pardini et al. circuit breaker is used to interrupt short circuit current at rated voltages in excess of 500 volts, it has been determined that the glass fibers in the arc chute side supports could negatively affect arc interruption due to the presence of alkaline metals such as sodium and calcium in the glass fibers. The low ionization potential of these metals contributes to the conductivity of the arc, which in turn, interferes with the rapid extinction of the arc at the higher voltages.

U.S. pat. application No. Ser. No. 056,187, filed June 1, 1987, entitled "Electric Circuit Breaker Arc Chute Composition" describes a three-layer laminate structure for arc plate side supports wherein the outer layers consist of a resin-impregnated cloth fiber while the inner support layer consists of a resin-impregnated glass fiber. The three-layer configuration ensures that the higher resistance cloth fibers face the circuit breaker contacts.

One purpose of the instant invention accordingly is to provide arc chute side support materials having the necessary thermal and electrical resistant properties while avoiding ionization of the glass components by means of an oriented and color-coded two-layer configuration which is less expensive to manufacture than the three-layer design.

SUMMARY OF THE INVENTION

Current limiting electric circuit breakers rated in excess of 400 volts utilize a two-layer arc chute side support structure for deionizing and cooling electric arcs. The second layer consists of a thermoset resin having a woven glass fabric encapsulated therein. The first layer consists of a similar thermoset resin having a linen cloth woven fabric encapsulated therein. The two layers are separately color-coded to insure that arc resistance cloth-resin composition faces the circuit breaker contacts.

DESCRIPTION OF THE PREFERRED EMBODIMENT

Figure 1:
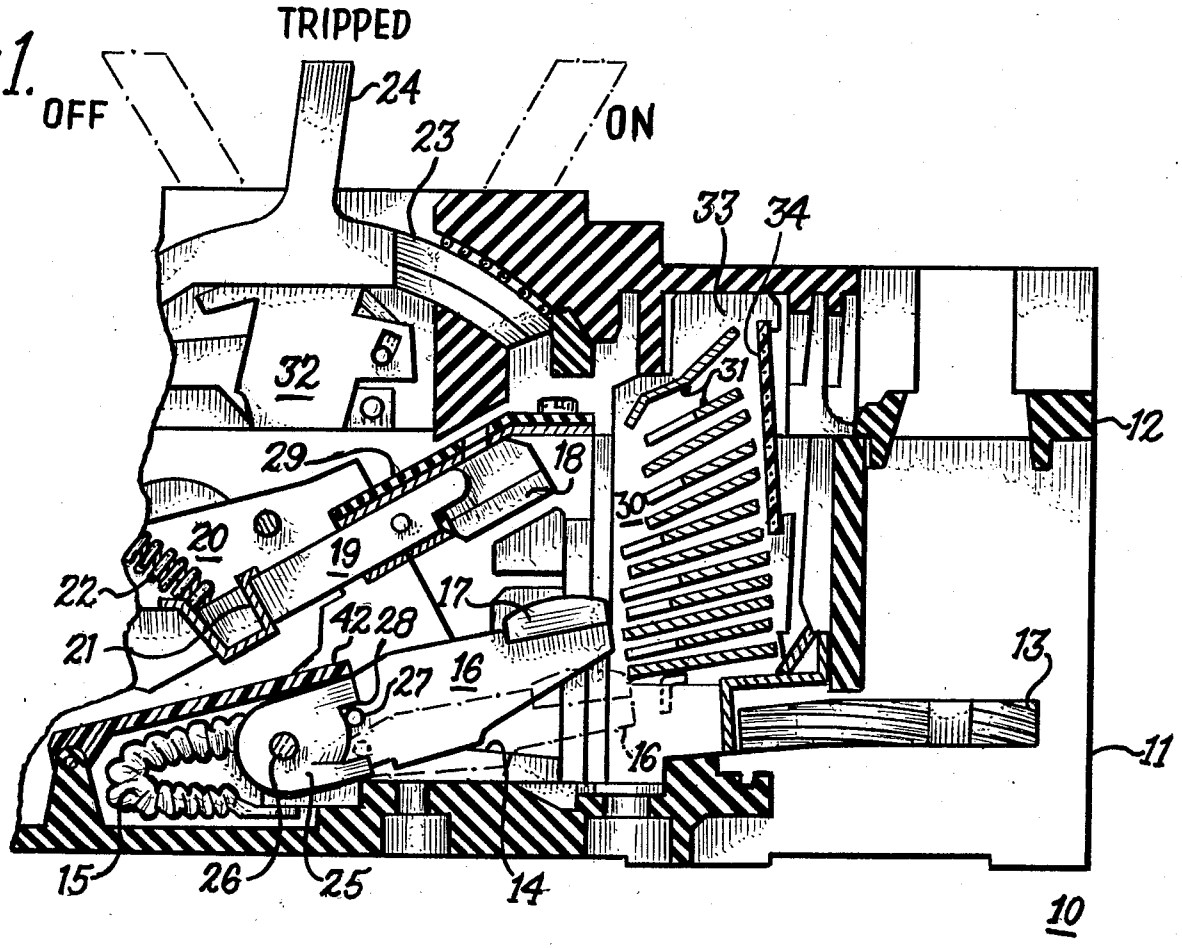
FIG. 1 is a side view in partial section of a molded case circuit breaker containing the arc chute according to the invention.

A molded case circuit breaker 10, similar to that described within the aforementioned patent to Pardini et al, is shown in FIG. 1 to consist of an insulative case 11 and an insulative plastic cover 12. A line terminal 13 connects with a bottom contact carrier 16 by means of a line strap 14 and a copper braid conductor 15. A bottom contact 17 is welded or brazed to the bottom contact carrier for cooperating with an upper contact 18 welded or brazed to an upper contact carrier 19, as indicated. The upper contact carrier 19 is operated by means of an operating mechanism generally depicted at 20 and is biased in a clockwise direction by means of a contact spring 22 to insure good electrical connection between the upper and lower contacts 18, 17, when the operating handle 24 is moved to its "ON" position. The operating handle cooperates with the operating mechanism 20 and the crossbar 21 by means of the handle skirt 23 and a pair of mechanism side frames 32, one of which is removed to clearly show the lower contact carrier support 25 and pivot pin 26. The lower contact carrier is depicted in its tripped position, wherein the pin 27 attached to the lower contact arm carrier 16 is at its uppermost position within the slot 28 formed within the support 25. When the operating handle is "on" the contacts are in the closed position, indicated in phantom with pin 27 at its bottommost position within the slot. In order for the upper and lower contact carriers 19, 16 to be closely spaced together for maximum electrodynamic repulsion upon short circuit conditions through the contacts, an insulating plate 42 is arranged between the contact carriers to prevent inadvertent electrical conduction between the contact carriers. An upper insulating plate 29 is positioned above the upper contact carrier 19 to act as a stop for the upper contact carrier when driven to its tripped position and to assist in motivating the arc away from the contacts into the arc chute 30 which is positioned intermediate the contacts and the line terminal 13. The arc chute 30 contains a plurality of spaced metallic arc plates 31 supported by a pair of side supports 33, one of which is removed to show the location of the arc plates with respect to the back support 34. The back support 34 is formed from a high temperature-resistant insulative fiber material.

Figure 2:
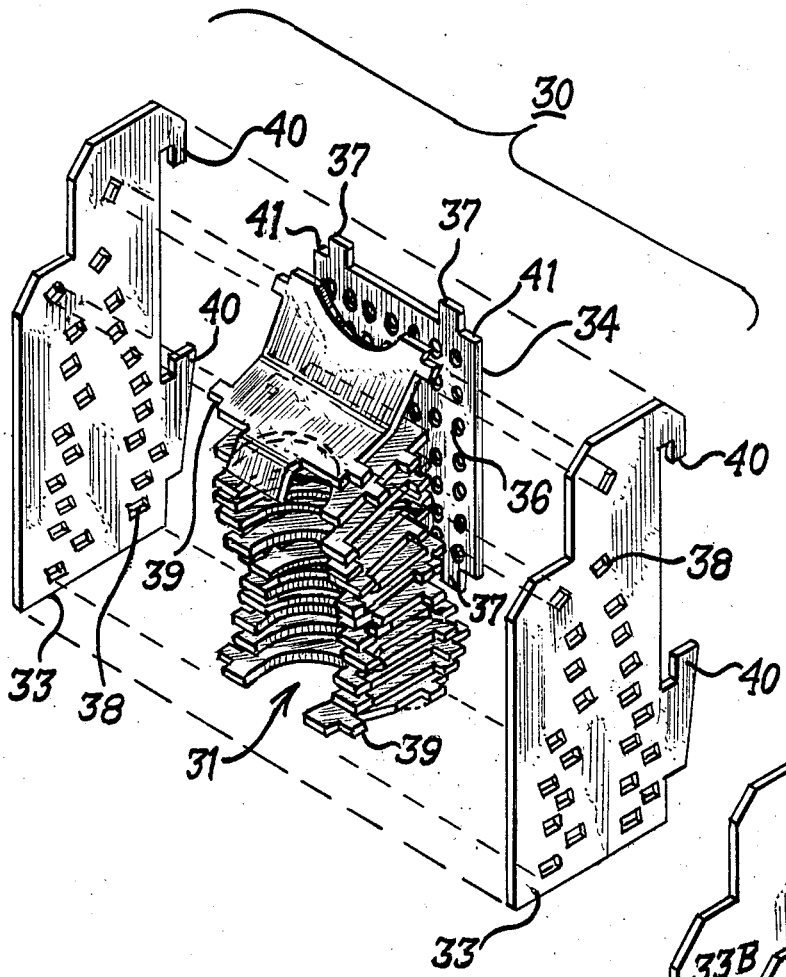
FIG. 2 is a top perspective view in isometric projection of the arc chute used within the circuit breaker depicted in FIG. 1.

The configuration of the arc chute is best seen by referring to FIG. 2 wherein the arc chute side supports 33 contain a plurality of slots 38 punched or formed therein for receiving a corresponding plurality of tabs 39 formed within the metallic arc plates 31. The side supports are attached to the back support 34 by arranging the hooked projections 40 on the side supports over the edges 41 formed on the top surface of the back support next to and outboard the pair of upstanding tabs 37. In operation, the arc is electrodynamically driven within the arc plates 31 where it is cooled and quenched as rapidly as possible. To assist in the arc-quenching process, the side supports 33 include a plastic resin material which becomes heated and evolves a substantial quantity of gaseous material having a high ionization potential which immediately becomes expelled from the arc chute through a series of holes 36 arranged through the back support to cool the arc.

Figure 3:
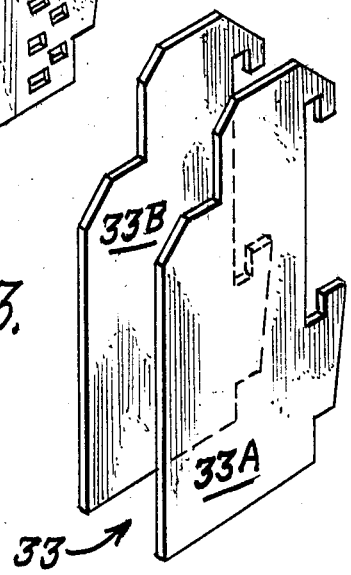
FIG. 3 is a top perspective view of the side support used within the arc chute of FIG. 2.

When current limiting circuit breakers, such as that described within the aforementioned patent to Pardini et al., are used in circuits in excess of 500 volts, it is found that the glass material used within the circuit breaker arc chute side supports becomes vaporized and thereby reduces the arc quenching properties of the arc chute. This invention contemplates the use of a two-layer side support 33, as shown in FIG. 3, wherein a first layer 33A hereafter "insulating layer" is exposed to the arc and the second layer 33B hereafter "support layer" is oriented away from the arc. The insulating layer 33A must have good insulating properties at the elevated arc temperatures involved. A suitable material having good electrical dielectric properties at elevated temperatures comprises a woven cloth fiber impregnated with melamine resin. The melamine resin, for purposes of this disclosure, is defined as the combination of melamine with formaldehyde with the melamine having the composition $C_3H_6N_6$. The formaldehyde is defined as having the composition HCHO wherein gaseous hydrogen compounds are released at the elevated temperatures to deionize and quench the arc. When melamine resin-impregnated woven linen fibers are used as the side supports, per se, the linen material exhibits excellent high temperature electrical resistance to the arc but does not have sufficient strength to support the arc plates upon repeated arc occurrences. The support layer 33B consisting of the melamine resin-impregnated woven glass fibers does have sufficient strength to withstand the elevated arc temperatures without becoming damaged at elevated temperatures as described earlier.

Figure 4:
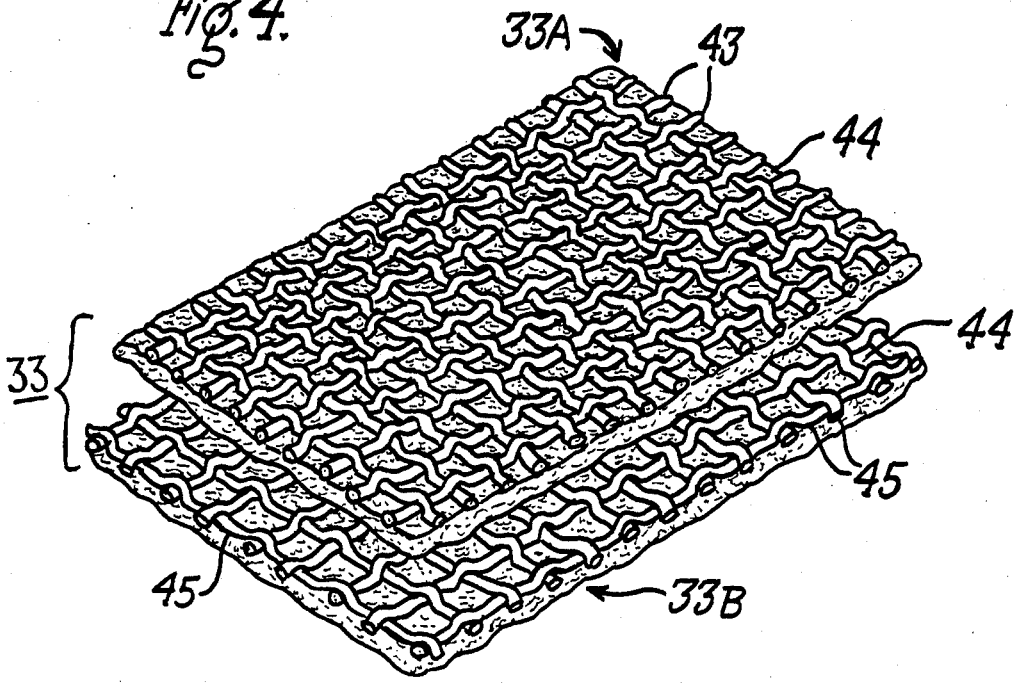
FIG. 4 is an enlarged top perspective view of one of the side supports depicted in FIG. 3 prior to lamination.
Figure 5:
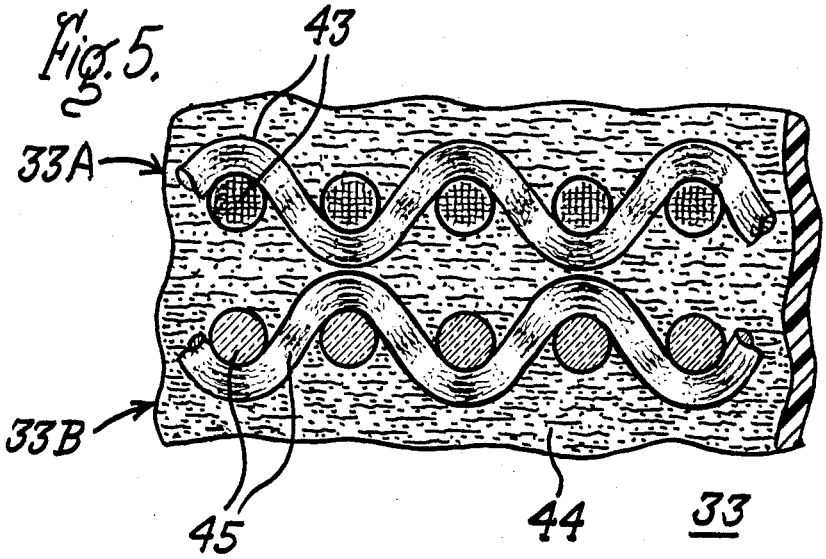
FIG. 5 is an enlarged sectional view of the side support depicted in FIG. 4 after lamination.

The fabrication of the two-layer side support 33 is best seen by referring now to FIGS. 4 and 5 wherein a plurality of woven glass fibers 45 are impregnated with the melamine resin 44 to form the support layer 33B. The insulating layer 33A is formed from a plurality of woven linen fibers 43 which are also impregnated with the melamine resin 44. Additional melamine resin is applied to the interface between layers 33A, 33B and the layers are heated and pressed together to form the composite side support 33 shown in FIG. 5. When such a composite side support is used in arc chutes, it is important that the insulating layer 33A which contains the linen fibers 43 face the circuit breaker contacts in order to be exposed to the arc. To insure the proper orientation of the side plates 33 after lamination, a color-coding arrangement is generally employed to insure that both opposing side plates facing toward the arc will comprise the linen fibers.

A current limiting circuit breaker having excellent interruption properties at voltages in excess of 500 volts has herein been disclosed. An arc chute containing a plurality of metal plates supported by a two-layer laminated side support is also described. The side support comprising a first layer of woven linen fibers impregnated with a melamine resin which is laminated onto a second layer containing woven glass fibers within the same melamine resin by heating and pressing the two layers together while the melamine resin is in a fluid state.

Having thus described my invention, what I claim as new and desire to secure by Letters Patent is:

1. A current limiting circuit breaker comprising:

a molded plastic case and cover;

a pair of separable contacts arranged at the ends of a corresponding pair of contact carriers within said case;

an operating mechanism connected with one of said contact carriers for moving one of said contacts between open and closed positions; and an arc chute facing said contacts and receiving an arc which forms when said contacts are separated while current flows through said contacts, said arc chute including a plurality of metal arc plates supported by a pair of opposing side supports, each of said side supports comprising a first layer of woven cloth fibers impregnated with a plastic resin arranged on a second layer of woven glass fibers impregnated with said plastic resin.

2. The current limiting circuit breaker of claim 1 wherein said resin comprises the combination of melamine with formaldehyde.

3. The current limiting circuit breaker of claim 1 wherein said cloth comprises linen.

4. The current limiting circuit breaker of claim 2 wherein said melamine comprises $C_3N_6H_6$.

5. The current limiting circuit breaker of claim 1 wherein said first and second layers are laminated together by heating and pressing.

6. The current limiting circuit breaker of claim 1 wherein said opposing side supports are oriented such that said first layer of one of said side supports apposedly faces said first layer of the other of said side supports.

7. The current limiting circuit breaker of claim 1 further including an apertured back support, each of said side supports being attached to said back support.

8. The current limiting circuit breaker of claim 7 wherein each of said side supports includes a hooked projection on a top surface, said hooked projection engaging a top edge of said back support.

9. The current limiting circuit breaker of claim 1 wherein said first and second layers are color-coded.

10. The current limiting circuit breaker of claim 1 wherein said first layer is provided with a different color from said second layer.

11. An arc chute comprising:

a pair of opposing side supports attached to a perforated back support;

a plurality of metallic arc plates extending between said side supports;

each of said side supports comprising a first layer of woven cloth fibers impregnated with a plastic resin arranged on a second layer of woven glass fibers impregnated with said plastic resin;

whereby said first layer on one of said side supports faces said first layer on the other of said side supports.

12. The arc chute of claim 11 wherein said first and second layers are laminated together by heating and pressing.

13. The arc chute of claim 11 wherein said plastic resin comprises the combination of melamine with formaldehyde.

14. The arc chute of claim 13 wherein said melamine comprises $C_3N_6H_6$.

15. The arc chute of claim 11 wherein each of said side supports includes a hooked projection on a top surface engaging a corresponding top edge on said back support.

16. The arc chute of claim 11 wherein each of said metallic arc plates include a pair of tabs engaging complementary slots formed within each of said side supports.

* * * * *